US005462114A

United States Patent [19]

Catanese, Jr.

[11] Patent Number: 5,462,114

[45] Date of Patent: Oct. 31, 1995

[54] SHUT-OFF CONTROL SYSTEM FOR OIL/GAS WELLS

[76] Inventor: Anthony T. Catanese, Jr., 724 First St., Mamaroneck, N.Y. 10543

[21] Appl. No.: 154,594

[22] Filed: Nov. 19, 1993

[51] Int. Cl.[6] ..... E21B 34/06; E21B 34/16

[52] U.S. Cl. ..... 166/53; 166/72; 166/95.1

[58] Field of Search ..... 166/53, 67, 72, 166/95, 97, 363, 364, 349; 169/69

[56] References Cited

U.S. PATENT DOCUMENTS

| | | | |
|---|---|---|---|
| 714,146 | 11/1902 | Cheesman | 166/72 X |
| 2,000,381 | 5/1935 | Duffy | 169/69 X |
| 3,419,076 | 12/1968 | Sizer et al. | 166/72 |
| 3,747,618 | 7/1973 | Boes | 137/80 |
| 3,866,676 | 2/1975 | Burns | 166/72 X |
| 4,163,477 | 8/1979 | Johnson et al. | 166/363 |
| 5,156,212 | 10/1992 | Bryant | 166/95 X |

FOREIGN PATENT DOCUMENTS

| | | | |
|---|---|---|---|
| 4116473 | 11/1992 | Germany | 166/72 |

*Primary Examiner*—Hoang C. Dang
*Attorney, Agent, or Firm*—Lackenbach Siegel Marzullo Aronson and Greenspan

[57] ABSTRACT

A shut-off control system for an oil/gas well casing is described which is intended to protect a discharge manifold from which the oil or gas is extracted. An explosion-proof bunker is positioned below the ground level and contains a valve which can be opened to permit flow of oil or gas through the well casing or to a closed condition in which the flow is inhibited. An actuator is mechanically coupled to the valve. A normally inaccessible closure system is provided which is at least partially disposed below ground level and is connected to the actuator for selectively controlling the condition of the actuator to permit or inhibit the flow of oil or gas through the well. In one embodiment, a fail-safe system is described which includes hydraulic accumulators in the bunker and a control circuit for monitoring and sensing alarm or abnormal conditions for automatically applying energy stored in the accumulators to the actuator to automatically close the flow of oil/gas in the well. In another embodiment, an enclosure is arranged below ground level at a location the spatial coordinates of which are known. Hydraulic conduits and connectors within the enclosure are connected to the actuator, so that upon location of the enclosure selective application of a pump to the connectors can be used to close the valve. Both embodiments can be used separately or together to provide extra redundancy and reliability.

38 Claims, 10 Drawing Sheets

SHUT-OFF CONTROL SYSTEM FOR OIL/GAS WELLS

BACKGROUND OF THE INVENTION

This invention generally relates to control systems and, more specifically, to shut-off control systems for oil and gas wells upon detection of an abnormal condition.

Oil and gas wells are particularly vulnerable to terrorist activities. Such wells are normally in developed oil producing regions or in oil and/or gas exploration cites, most frequently removed from populated areas. Such wells are popular targets of terrorists because of the ease of performing terrorist acts in such secluded areas and also because such acts can create substantial damage. Aside from damage to the well(s) and the potential losses in revenues as a result of oil and/or gas being released to the surrounding areas, the potential for personal injuries and for damage to the environment is also significant. See, for example, a description of the devastation which took place in Kuwait when over seven hundred wells were set aflame "the Persian Gulf after the Storm", National Geographic, Vol. 180, No. 2 August 1991, pps. 2–35. Enormous clouds of smoke threatened crops in the region with acid rain at least as far as east as India and Pakistan. Black rain and black snow had also been reported in Bulgaria, Turkey and Southern Soviet Union, Afghanistan and Northern India, with such disastrous consequences being easily achievable by directed terrorists, oil and gas wells continue to be exposed to damage as occurred in Kuwait during the Persian Gulf War. Unfortunately, skilled and well-funded terrorists normally have the ability to by-pass fail-safe systems and penetrate security zones to cause damage of the type which took place in Kuwait. Simple measures, therefore, such as providing perimeter fencing, security in the form of alarms, etc., can do little to stop terrorist or natural disasters such as earthquakes, tornadoes, etc. Smoke from oil wells set on fire by Iraqi troops caused health and environmental problems across Kuwait and disrupted weather patterns up to fifteen hundred miles away. Polluted fallout from the smoke had coated as much as seventy-five percent of Kuwait's desert with a tar-like layer that disrupted fragile plant and animal life. The fallout from the smoke also contaminated the Persian Gulf, threatening the desalinization plants along the Gulf Coast that provided fresh water to Kuwait and Saudi Arabia. Such soot was particularly troublesome because, when combined with the chlorine used to purify water at the plants, formed chlorinated hydrocarbon compounds, which are believed to be carcinogenic.

Kuwait officials estimated that approximately six million barrels of oil a day were going up in smoke at a cost of more than $1,000 a second. Firefighting efforts, at their peak, involved ten thousand workers from thirty-four countries. Efforts to stop the burning wells cost between 1.5 and 2 billion dollars according to Kuwait and Western estimates. Approximately six hundred million barrels of oil worth a total of twelve billion dollars had been lost in the fires, with an 25–50 million barrels of oil having been spilled on Kuwait's desert floor.

SUMMARY OF THE INVENTION

Accordingly, it is an object of the present invention to provide a shut-off control system for oil/gas well casings which can effectively deal with and eliminate the devastating results that may be caused by terrorists.

It is another object of the present invention to provide a shut-off control system for oil/gas wells which can be used in connection with wells in remote locations without the need to provide additional security for the wells.

It is still another object of the present invention to provide a shut-off control system of the type mentioned in the previous objects which can be incorporated into new well constructions as well as be retro-fitted into existing wells.

It is yet another object of the present invention to provide a shut-off control system of the type aforementioned which is fail-safe and virtually impossible to defeat.

It is a further object of the present invention to provide a shut-off control system of the type under discussion which can reliably shut down a well within approximately 3–5 seconds upon the occurrence of any one of a predetermined number of alarm conditions.

It is still a further object of the present invention to provide a shut-off control system as in the previous objects which cannot again be actuated without specific authorization from a remote monitoring control station.

It is a yet further object of the present invention to provide a shut-off control system as described in the previous objects which provides multiple levels of redundancy.

It is yet a further object of the present invention to provide a shut-off control system for use in oil and/or gas wells which can be reliably utilized in places where no utilities are provided, such as electric or gas distribution networks for powering the shut-off control system.

It is an additional object of the present invention to provide a shut-off control system of the type under discussion which can be fully controlled and monitored from remote locations.

It is still an additional object of the present invention to provide a shut-off control system which has all of the aforementioned advantages and which can be operated for extended periods of time.

It is yet an additional object of the present invention to provide a shut-off control system as in the previous objects which requires minimum maintenance and it is self-sufficient almost indefinitely without replenishment of supplies.

It is another object of the present invention to provide a shut-off control system as aforementioned which can operate reliably under the most adverse conditions and is unaffected by the elements, including high temperatures, wind storms, and the like.

In order to achieve the above objects, as well as other which will become apparent hereafter, a shut-off control system for an oil and/or gas well casing an upper portion which extends above ground level and then is connected to a discharge manifold and the lower portion of which extends below ground level to a oil or gas dome from which the oil or gas extracted in accordance with the present invention comprises an explosion proof bunker or protective enclosure positioned a predetermined distance below ground level. The explosion-proof bunker is substantially full enclosed but has input and output openings through which said well casing enters and exists said bunker. Fail means is provided within said bunker for permitting flow of oil or gas through said well casing when in an open condition and for inhibiting flow through said casing when in a closed condition. Actuator means is provided mechanically coupled to said valve means for actuating said valve means to said open or closed conditions. Normally inaccessible closure means is provided at least partially disposed below ground and connected to said actuator means for selectively controlling the conditions of actuator means. In this manner, undesired flow of oil/gas can be terminated in the event of an abnormal condition at the discharge manifold.

According to one presently preferred embodiment, said closure means comprises accumulator means for accumulating stored energy. A sensor means are provided for sensing at least one abnormal or alarm condition. Control circuit means is provided for monitoring said sensor means and for issuing an alarm signal when an alarm condition is detected and for applying said energy stored in said accumulator means to said actuator means upon the occurrence of an alarm condition. In this manner, said valve means can automatically close the flow of oil or gas in the well casing upon the occurrence of an alarm condition.

In accordance with another presently preferred embodiment, said actuator means comprises a hydraulic actuator which a cylinder with first and second lines, and a piston within said cylinder connected to a retractable and extendable rod coupled to said valve means. Application of hydraulic fluid under pressure to said first hydraulic line closes said valve means, while application of hydraulic fluid under pressure to said second hydraulic line opens said valve means. A control system further comprises an enclosure arranged below ground level at a location the spacial coordinates of which are known. Two separate and distinct connectors are provided within the enclosure. Hydraulic conduits are provided which connect each of said connectors to another one of first and second hydraulic lines. A check valve means for preventing the escape of hydraulic fluid from said hydraulic conduits through said connectors are provided. In this manner, location of the enclosure and selected application of a pump with a mating connected to one of said two distinct connectors enables the valve means to be open or closed.

The two presently preferred embodiments may be used separately or in combination to provide secondary emergency or backup closure systems. Also, while the valve and/or actuator means are preferably housed in walk-in explosion-proof bunkers, the invention can also be practiced by placing said valve and/or actuator means into any protective enclosure suitable for being placed below ground level so as to be generally inaccessible.

BRIEF DESCRIPTION OF THE DRAWINGS

The invention will now described in more detail, by way of examples, with reference to the accompanying drawings, in which.

DESCRIPTION OF THE PREFERRED EMBODIMENTS

Figure 1:
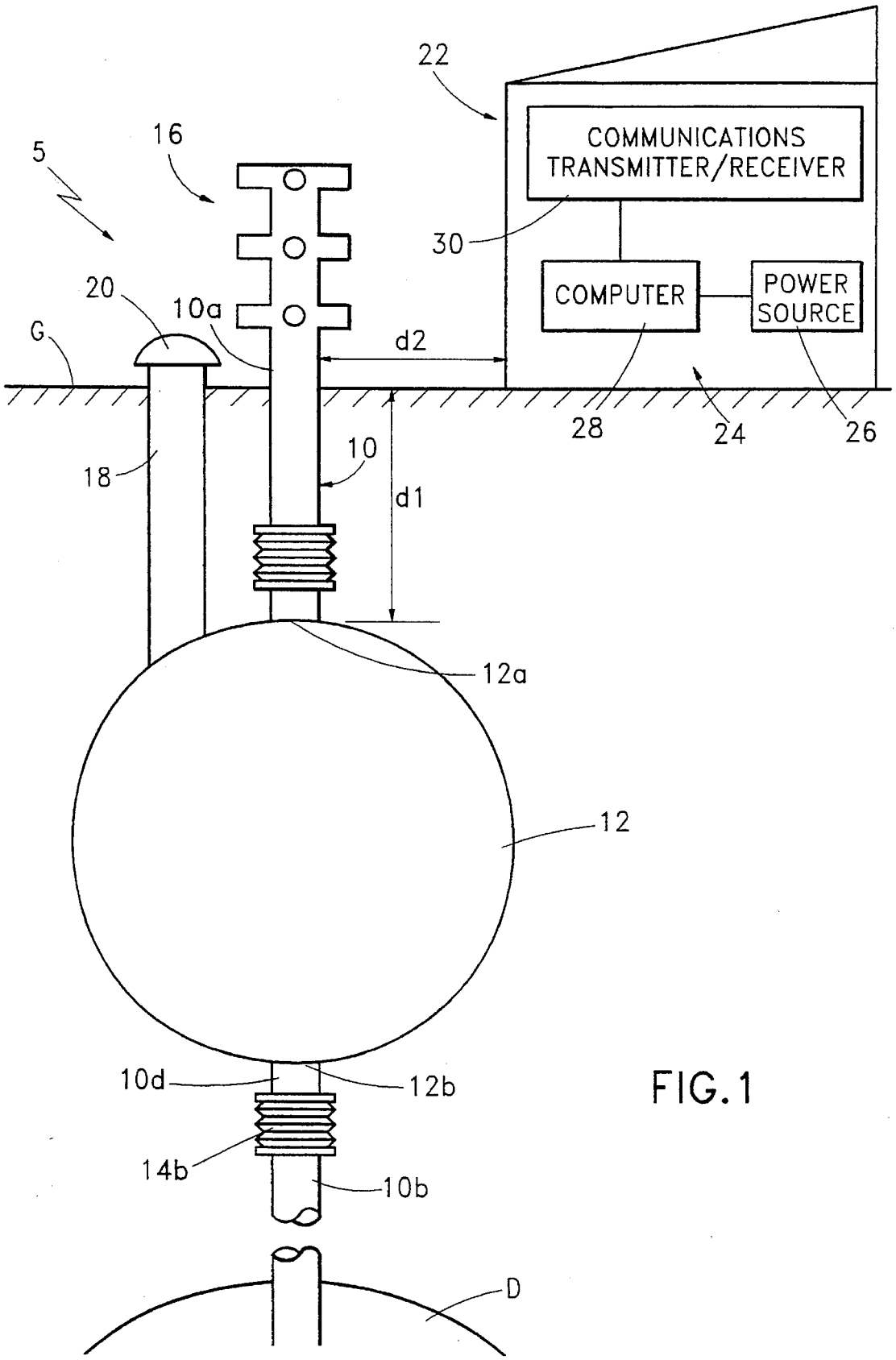
FIG. 1 is a schematic representation of a shut-off control system in accordance with one embodiment of the present invention.

Referring now specifically to the drawings in which identical or similar parts are designated by the same reference numerals throughout, and first referring to FIG. 1, a shutoff control system in accordance with the present invention is illustrated and generally designated by the reference numeral 5.

The system 5 is used for stopping flow of oil/gas through an oil/gas well casing 10. The casing 10 has an upper portion 10*a* which extends above ground level G and a lower portion 10*b* which extends below ground level to an oil/gas Dome D from which oil or gas is extracted.

An important feature of the shut-off control system in accordance with the present invention is the provision of an explosion-proof bunker 12 positioned a predetermined distance $d_1$ below ground level G. Preferably, the distance $d_1$ is approximately within the range of 10–20 feet below ground level G.

Figure 2:
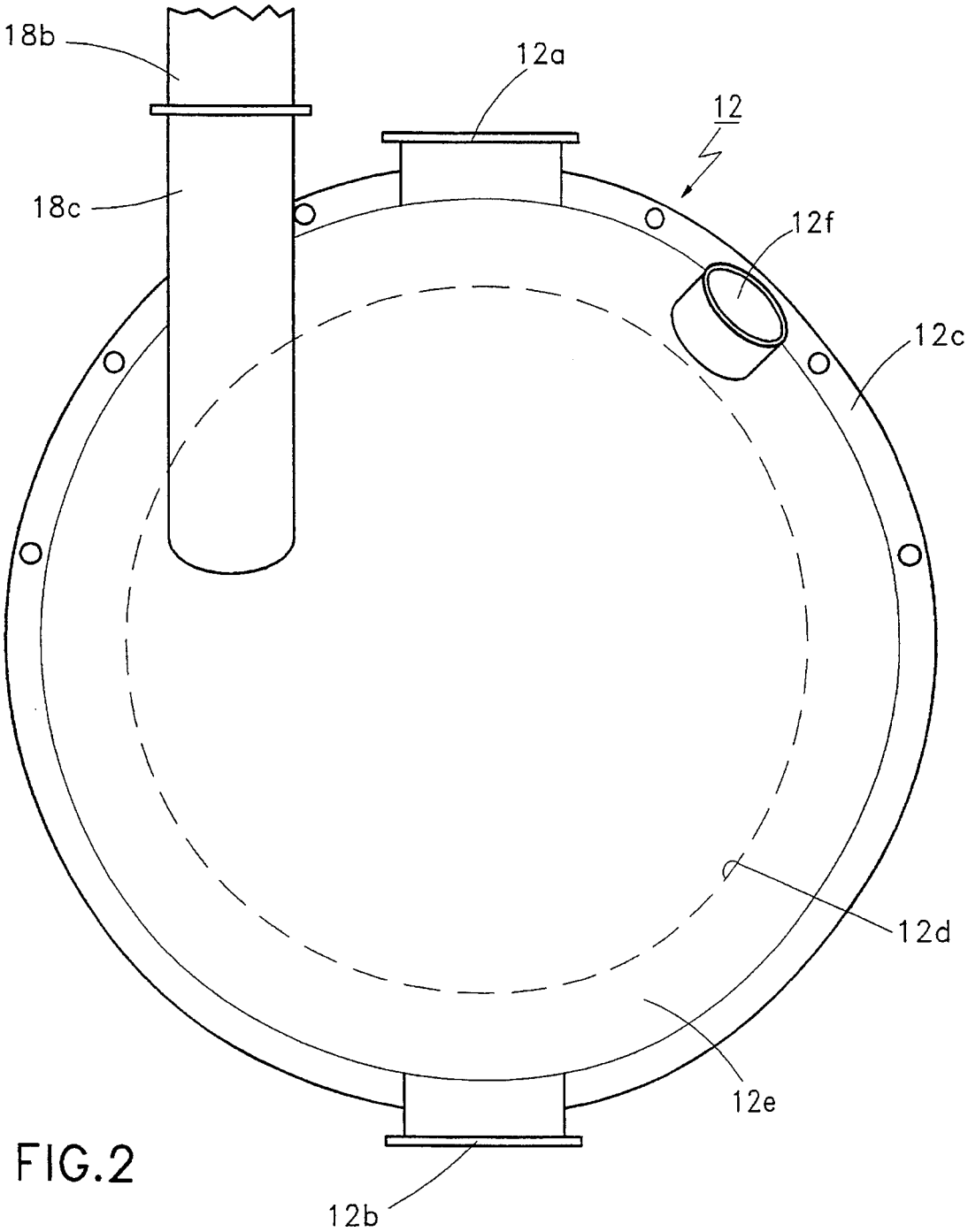
FIG. 2 is a schematic representation of an exterior mold that can be used to make the cast-in-place below ground bunker shown in FIG. 1.

The bunker 12 may be pre-fabricated but more probably it is more practical to cast the bunker 12 in place at the site where it is going to be buried below the ground. Referring to FIG. 2, it will be noted that this can be accomplished by using an outer shell 12*c* and inner shell 12*d* which have different diameters and, therefore, provide a space 12*e* in the form of a cylindrical shell which can be filled with reinforced concrete through a manhole 12*f* for pouring the concrete. By way of example only, the diameter of the outer shell 12c may be approximately sixteen feet in diameter, and the diameter of the inner shell is approximately ten feet. With these exemplary dimensions, the cast-in-place bunker 12 would have a reinforced concrete wall of approximately three feet in thickness. This thickness can be increased or decreased, as desired or as necessary. If decreased, the resistance to bombing or explosion would be decreased, while increasing the thickness of the wall would increase the costs in the implementation of the invention. Seamless spherical tanks are well known and can be used to cast the bunker 12 in place. For example, double wall seamless fiberglass shells are available from Cardinal Fiberglass Industries of Perth Amboy, N.J.

Advantageously, flex joints 14a and 14b are used proximate to the upper and lower surfaces of the bunker 12 to minimize breakage or other damage to the casing 10 in the event of a large explosion proximate to the bunker 12. Thus, the bunker 12 is substantially fully enclosed but has an upper input opening 12*a* through which a section of the casing 10*c* enters and a lower output opening 12*b* through which portion 10*d* of the casing exists the bunker. The casing sections 10*a* and 10*c* are joined together by means of the flex joint 14*a*, while the casing portions 10*b* and 10*d* are joined to each other by means of flex joint 14*b*.

Extending above the ground level G, the casing portion 10*a* is connected to a discharge manifold 16, sometimes referred to as "Christmas tree". The discharge manifold is the part of the oil well which is initially accessible to a potential terrorist and that is the component that is most susceptible to damage and/or bombing.

As will be more fully discussed in connection with FIG. 4, there is advantageously provided a manway 18 which extends from a point just above ground level G into the bunker 12, the entrance to the manway 18 being in nature of a cover 20 which is made tamperproof. Since the manway 18 and the cover 20 as well as the discharge manifold 16 are all above ground level and exposed to potential terrorist attacks, both of these elements are specifically protected by the shut-off control system 5 of the present invention, as will be described hereinafter.

Referring to FIG. 1, an important feature of a first embodiment of the invention is the provision of a sacrificial above-ground level structure in the form of a shed 22 which is in relative proximity to the discharge manifold 16 for housing at least a portion of the system for shutting flow in the well in the event of an abnormal condition. The shed 22 is spaced a distance $d_2$ which is not in and of itself critical. However, the distance $d_2$ should be selected and the shed 22 designed to essentially shatter or disintegrate upon the occurrence of an explosion in proximity to the discharge manifold 16. As will be discussed below, this will issue an alarm signal to shut down the flow of oil and/or gas. Contained within the shed 22 is support equipment 24 which cooperates with equipment within the bunker 12, to be described, for providing the shut-down protection. The support equipment 24 includes a power source 26. The power source 26 is connected to a computer or microprocessor-based control unit 28 which communicates with and controls a communications transmitter/receiver circuit 30. The computer 28 is linked to the equipment within the bunker 12 by means of an electrical conduit 32 which houses electrical cables through which electrical signals can be transmitted to and received from the bunker 12. The electrical conduit 32 may, for example, consist of PVC conduit.

Figure 3:
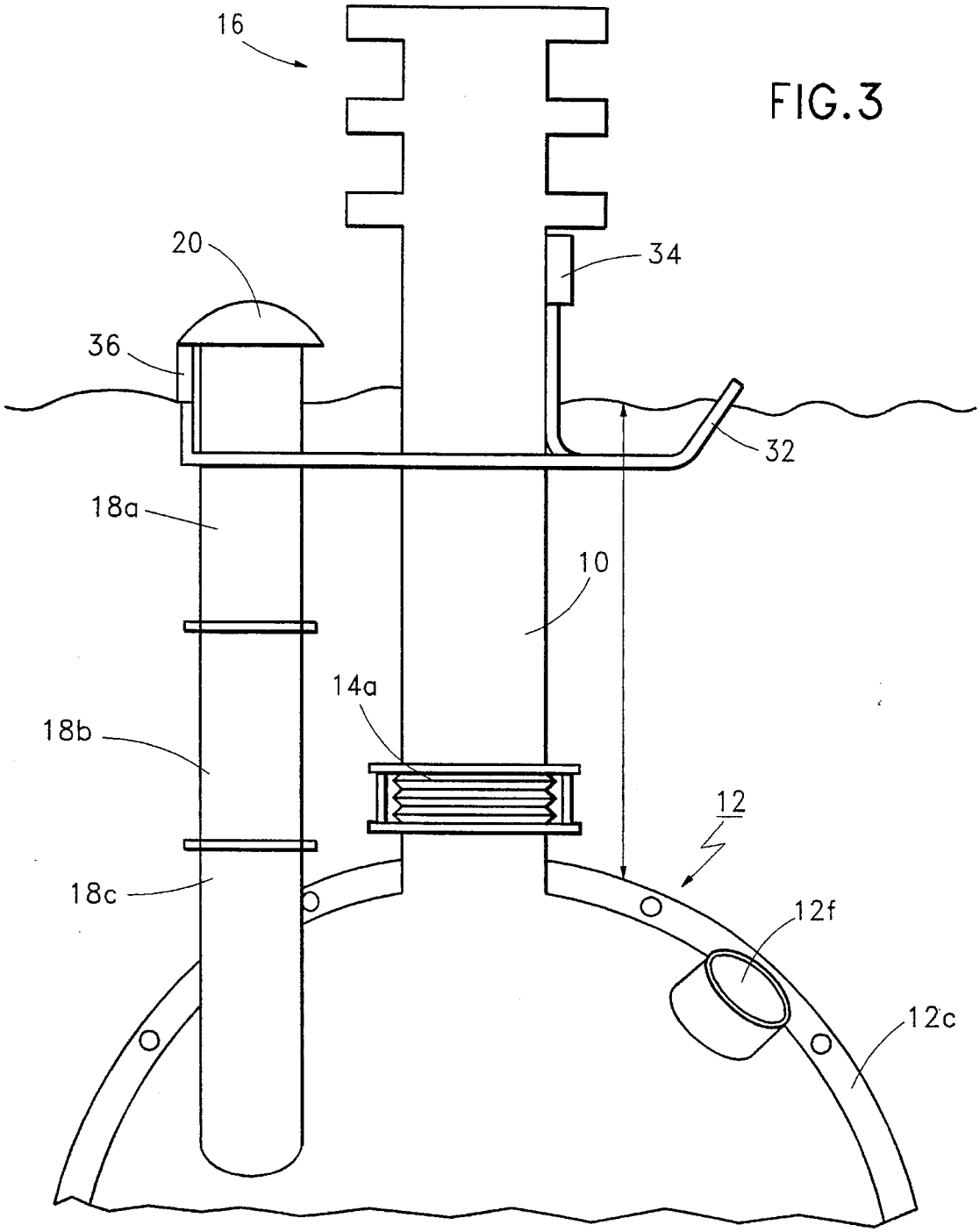
FIG. 3 is an enlarged schematic view of the region above the bomb-proof concrete bunker, showing a few of the sensor packs used to detect alarm conditions.

In the embodiment being described, which is a fail-safe and automatic shut-off control system responsive to almost any anticipated abnormal or alarm condition, there are advantageously provided a series of electrical sensors used in or about the bunker 12 as well as in or about the shed 22. Referring to FIG. 3, a few examples are shown of possible sensors that can be used. Thus, a sensor pack 34 is shown attached to the discharge manifold or Christmas tree 16, above ground, and a sensor pack 36 is also mounted above ground and attached to the manway 18 which, in FIG. 3, is shown to include three manway extensions 18*a*–18*c*. Although the manhole cover 20 would normally be locked and rendered tamper-proof, the sensor pack 36 would nevertheless detect tampering or opening of the cover or any damage thereto. Any suitable sensors may be used for this purpose. One example of a sensor pack that may be used is a fail-safe systems type 3 pack, housed in a NEMA 4X-316SS enclosure welded to the discharge manifold 16 and to the manway 36 as suggested in FIG. 3. Sensors may be provided on all major or critical components to detect abnormal conditions such as fire, abnormally high temperatures, shock, vibration, head pressure or flow rate in the casing 10, tampering, intrusion or motion within the bunker 12.

Figure 4:
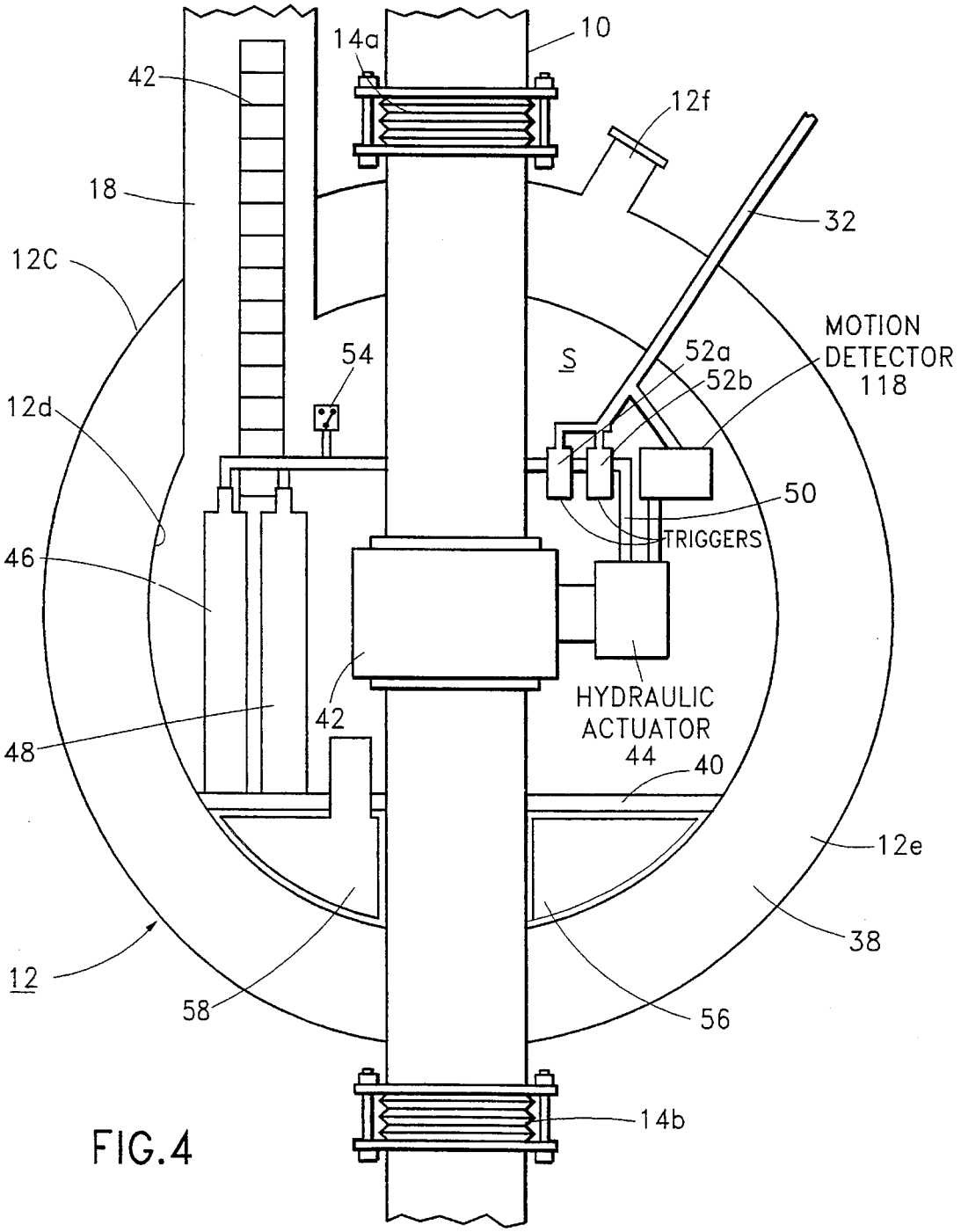
FIG. 4 is a schematic representation of a cross-section of the concrete bunker shown in FIG. 1, illustrating some of the details of the electrical and hydraulic systems for closing the well casing in the event of an alarm condition.

Referring to FIG. 4, a schematic is shown, in cross-section, of the bunker 12 of the embodiment shown in FIG. 1. The bunker space 12*e*, after it has been prepared at the site, is filled with steel or fiber reinforced concrete 38. Since the bunker 12 is cast-in place, the outer and inner shells or fiberglass molds 12*c*, 12*d*, respectively, also remain in place.

Inside the bunker, there is a spherical space S formed which is used to house certain equipment and control components as will now be described. There is advantageously provided a floor 40 which facilitates installation and maintenance of the control components. Above the floor 40 but within the space S there is provided a full port ball main valve 42 for permitting flow of oil or gas through the well casing 10 when it is in an open condition and inhibiting flow through the casing when in a closed condition. The valve 40 is, then, the main control valve for permitting or inhibiting the flow of oil from the Dome D above ground level G. A hydraulic actuator 44 within the space S of the bunker 12 is mechanically coupled to the main valve 42 for actuating the main valve to open or closed positions. Such opening or closing operations can be performed automatically upon the occurrence of an unusual or alarm condition, as in the case of the embodiment shown in FIG. 1, or can be performed manually as will be described in connection with FIGS. 9 and 10.

An important feature of the present invention is the provision of a normally inaccessible closure mechanism, device or system which is at least partially disposed below ground level G and is connected to the actuator 44 for selectively controlling the condition of the actuator. In this manner, undesired flow of oil or gas at the discharge manifold 16 can be terminated in the event of an abnormal condition.

In the first embodiment being described, such normally inaccessible closure mechanism includes two hydraulic accumulators 46, 48 for accumulating stored energy. Such hydraulic accumulators use oil as a hydraulic fluid separated from a volume of nitrogen gas which is compressed to provide the stored energy. Such hydraulic accumulators have been used for many years and are well-known to those skilled in the art. While one hydraulic accumulator may be sufficient, two accumulators are preferably used for redundancy in the event that one of the accumulators fails.

The accumulators are in fluid flow communication with the hydraulic actuator 44 by means of hydraulic conduit tube or pipe 50 by means of solenoid-actuated trigger valves 52*a*, 52*b*, the solenoids of which are connected to the computer 28 by means of the electrical conduit 32. Again, although one trigger valve may be sufficient, two are used in tandem to provide redundancy in the event of failure in one of these valves.

At least one pressure-controlled double throw switch 54 is connected to the conduit 50 and is responsive to the pressure in the conduit. The switch 54 is also electrically connected via the electrical conduit 32 (not shown) to the computer 28 to provide information as to predetermined threshold levels of pressure in the conduit 50.

In order to utilize the space S efficiency, there is advantageously provided a hydraulic oil reservoir 56 below the floor 40 and a charging pump 58 for pumping the oil in the reservoir 56 in a manner which will be described below.

Figure 5:
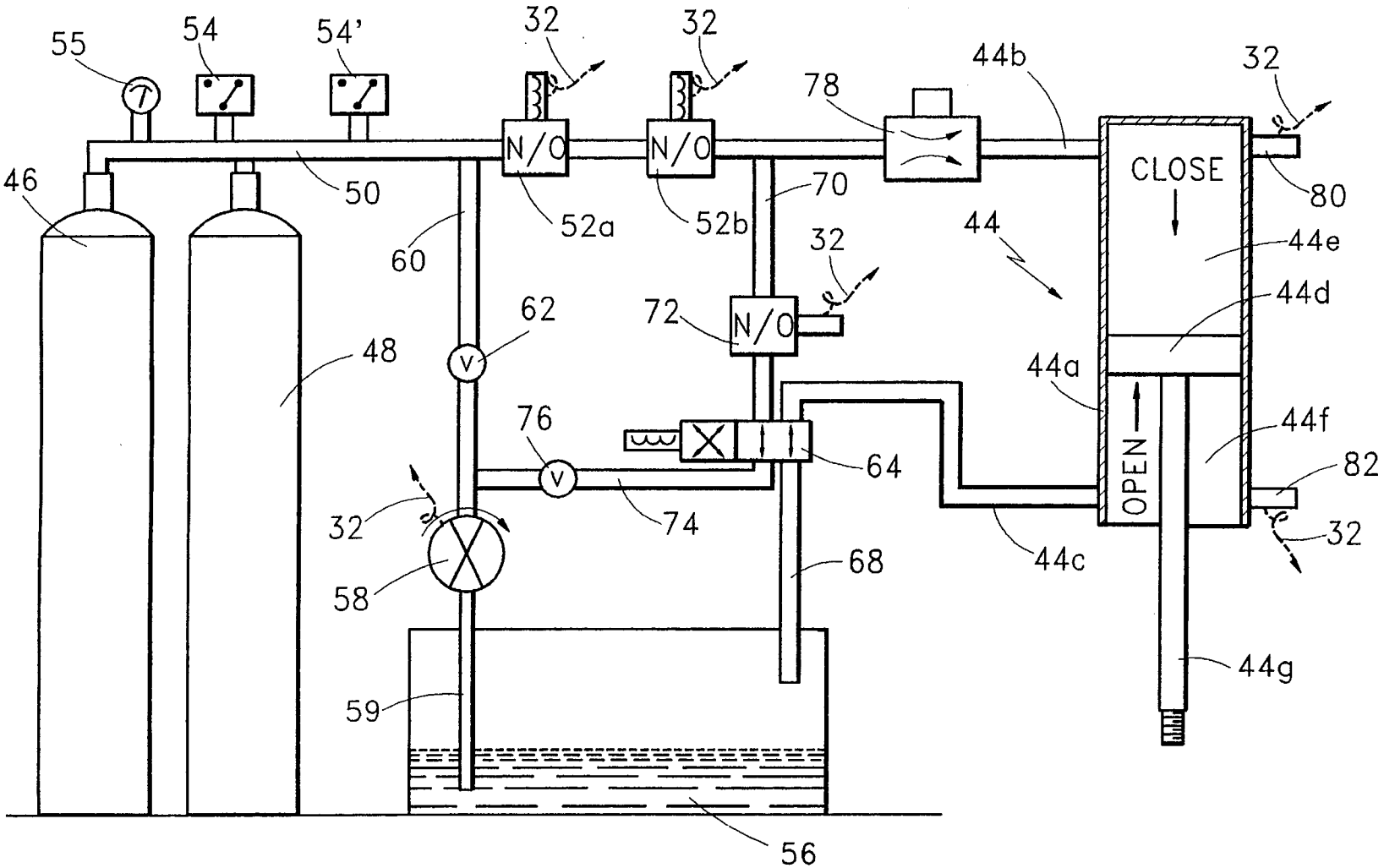
FIG. 5 is a hydraulic schematic of the hydraulic system shown in FIG. 4.

In FIG. 5, a schematic is illustrated of the hydraulic system for charging the accumulators 46, 48, starting or resetting the actuator 44 and for closing down the valve 42 with the actuator 44 upon the occurrence of an emergency or abnormal condition. There is preferably provided a second pressure responsive double throw switch 54' which is responsive to the pressure in the conduit 50. The use of the second pressure switch 54' is for the purpose of redundancy in the event that the pressure switch 54 becomes disabled or ineffective. There is also preferably provided a service pressure gauge 55 which provides a visual indication of the pressure in the conduit 50.

The solenoid controlled trigger valves 52*a*, 52*b* are connected in series or in tandem to each other, as shown, and are normally open (N/O) when no electrical power is applied to the solenoids of these valves. Therefore, removal of power from the solenoids of the valves 52*a*, 52*b* revert these valves to the normally open (N/O) condition thereby opening these valves and allowing hydraulic fluid to flow through these valves. The solenoids of valves 52*a*, 52*b* are connected to the computer in the shed 22 through the electrical conduit 32.

The hydraulic circuit includes an oil reservoir 56 which contains hydraulic oil or fluid and a charging pump 58 which communicates with the oil reservoir by means of conduit 59 which serves as the inlet to the charging pump 58. The charging pump 58 may be of any conventional or known type. In the presently preferred embodiment, such charging pump 58 is a ⅓ HP pump which is suitable for this purpose.

The outlet side of the pump 58 is connected to the primary hydraulic conduit 50 by of conduit 60 by way of an automatic lock check valve 62. The outlet side of the pump 58 is also connected to one port of a spring loaded four-port directional control valve 64 by means of conduit 74 in which there is provided an automatic lock check valve 76 as shown. Another one of the ports of the directional valve 64 opens into the oil reservoir 56 and serves as a discharge conduit for hydraulic fluid. A third port of the directional valve 64 is connected to the main conduit 50, at the downstream side of the trigger vanes 52*a*, 52*b*, through a two port charging block solenoid valve 72 which has a solenoid actuatable by the computer 28. The fourth port of the directional valve 64 is connected by means of conduit 66 to the actuator cylinder 44. The actuator cylinder 44 is also connected to the conduit 50 through an optional speed control valve which controls the rate at which hydraulic fluid flows under pressure through the main conduit 50 from the accumulators 46, 48 to the actuator 44. The speed control valve 78 is a manually adjusted element which is adjusted initially as a function of the pressure differentials applied during an emergency at the upstream and downstream ends of the main conduit 50 and the desired speed of closure of the main valve 42 and, therefore, controls the reaction speed or time constant of the actuator cylinder 44.

The actuator cylinder 44 includes a cylinder 44*a* which has a first hydraulic line 44*b* at one end of the cylinder and a hydraulic line 44*c* at the other end of the cylinder. Slidably mounted within the cylinder is a piston 44*d* which divides the volume of the cylinder into chambers 44*e*, 44*f* which can be filled with hydraulic oil or fluid under pressure so as to move the piston 44*d* and the rod 44*g* in order to control the opening and the closing of the main valve 42 by means of the rod 44*g* which is mechanically coupled to the main valve. As viewed in FIG. 5, when the upper chamber 44*e* receives hydraulic fluid at a differential pressure which is higher than that in chamber 44*f* the rod 44*g* is extended to close the main valve. The application of a higher differential pressure in chamber 44*f*, however, causes the rod 44*g* to retract and this causes the main valve to open.

Proximity switches 80, 82 are provided at the axial ends of the cylinder 44 as shown which are activated by the presence of the piston 44*d*, so that when the rod 44*g* is fully retracted, the piston 44*d* activates the proximity switch 80 while the proximity switch 82 is actuated when the rod 44*g* is fully extracted. The proximity switches 80, 82 are connected to the computer 28 through the electrical conduit 32.

Figure 6:
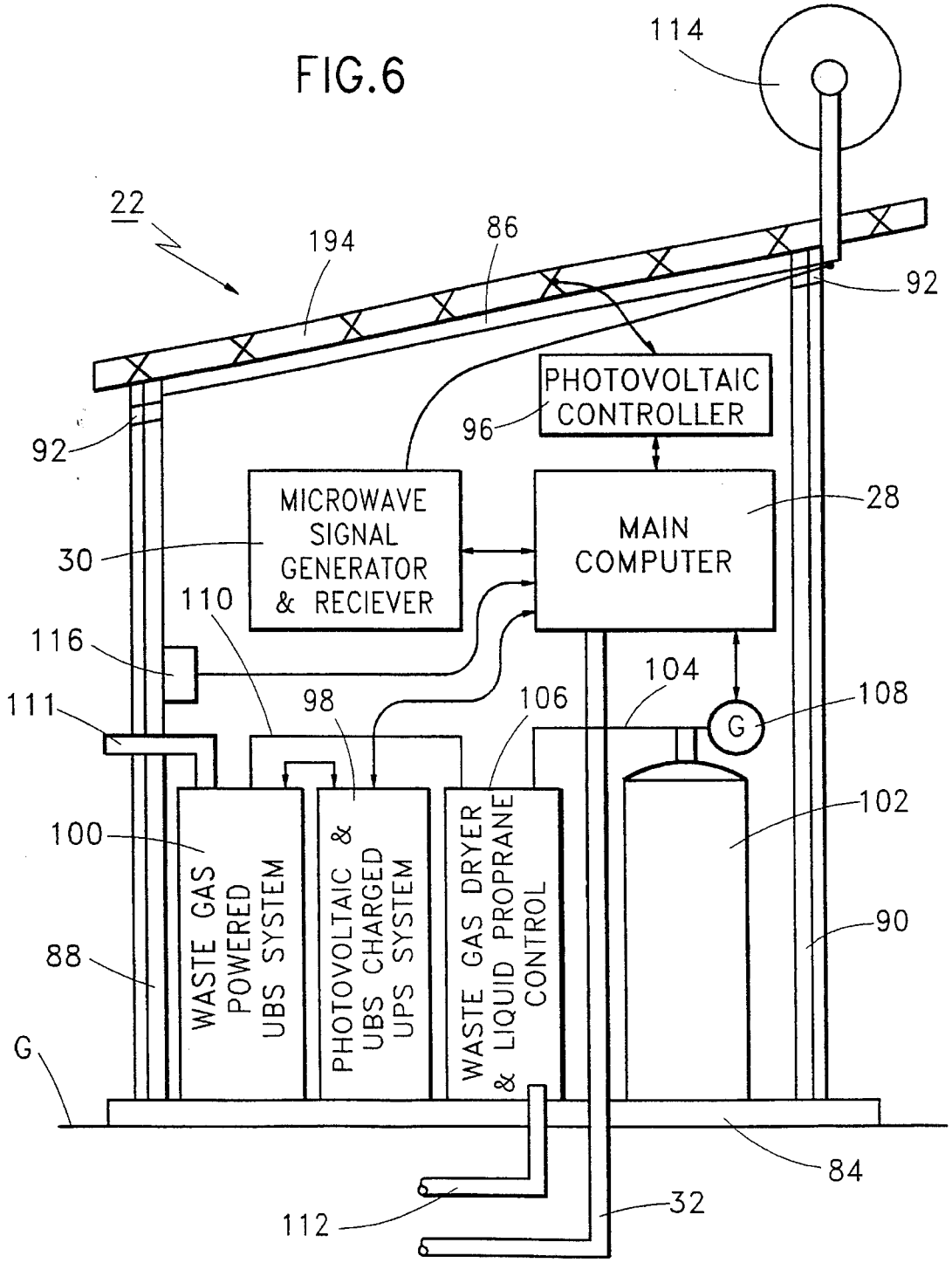
FIG. 6 is an enlarged representation of the above-ground shed as shown in FIG. 1, showing additional details regarding the support systems working with the hydraulic system illustrated in FIG. 4.

Referring to FIG. 6, additional details of the shed 22 in accordance with the invention are illustrated. Thus, the shed is preferably mounted on a poured concrete slab or foundation 84. While the thickness of the slab is not critical, an eight inch slab is satisfactory for this purpose. The control shed is constructed of insulated, pressure treated wood on the concrete base 84, and may be framed by 2×4 inch rafters. The roof 86 is shown inclined and is preferably inclined towards the Southern direction (in the Northern Hemisphere) in order to maximize the solar radiation impinging on the roof. The walls 88 and 90 (as well as the two walls which are not illustrated are covered with materials which can withstand adverse climatic conditions, including high winds, sand storms, etc. However, the shed is designed to be sacrificial so that, when placed in close proximity to the discharge manifold 16, any explosion, vibrations due to earthquake, etc. would also result in the shed 22 collapsing or structurally disintegrating. Because electrical equipment is maintained within the shed 22, there are advantageously provided air vents 92 for allowing heat to escape so as not to expose the electrical equipment to excessive temperatures.

As will be described in more detail, electrical equipment 24 is provided within the shed 22 and the various solenoids described in connection with FIG. 5 are electrically actuated by this equipment. The fail-safe shut-off control system, therefore, needs to be supplied with electrical power for operation. Redundant systems are provided as will be described. Once source of electrical energy is mounted on the roof 86 and is in the nature of a series of photovoltaic collectors 94 which are electrically connected to a photovoltaic controller 96 which is, in turn, controlled by the main computer 28. By sloping the roof 86 downwardly in a southern direction, the collectors 94 can, particularly, in areas like deserts, provide substantial electrical energy at least during their daylight hours. This energy can be used to operate the electrical equipment as well as recharge an uninterruptable power supply (UPS) 98. The UPS 98 is an important feature of the present invention since such oil well facilities are frequently in areas where there is no distribution of utilities and the system depends on constant availability of power during normal operating conditions. The UPS is selected to have a sufficiently high energy storing capacity to operate all of the components. However, since the equipment that is operated, including the solenoid valves inside the bunker 12, the computer 28 at the communications equipment 30 consumes less than 1 kVA of energy to drive all of the electrical components, the UPS should be rated at least 5 kVA to provide a safety margin and system reliability. Suitable UPS supplies are available, for example, from American Power Conversion of West Kingston, Rhode Island and Best Power Technology, Inc. of Necedah, Wis.

Since the shed 22 is in an isolated area which cannot normally be connected to a power grid, the system must be self-sufficient. While solar energy can provide most of the energy for the system, particularly by charging the UPS during the peak solar hours, the system should, advantageously, include additional sources of energy which can indefinitely maintain the system operational and in standby mode, irrespective of the availability of solar energy. For this purpose, there is provided an uninterruptable battery supply (UBS) 100. The UBS 100 is a battery charging unit which uses a number of different fuels to generate electricity and keep the UPS batteries up to full charge in the event of a prolonged absence of sunlight or photovoltaic failure. For this purpose, there is shown a liquid propane (L/P) emergency tank 102 connected by suitable conduit 104 to a gas dryer and L/P control 106. An L/P level pressure gauge 108 may be used to monitor the amount of gas left in the tank 102. Once the gas is dried, and upon demand, the L/P is fed to the UPS by means of conduit 100. An exhaust gas conduit 111 exhausts any waste gases to the outside. When available, and this is normally the case in oil/gas facilities, combustible waste gas may be provided to the UBS by means of conduit 112 which first directs the gas to the dryer and control 106. The L/P or the waste gas serves as fuel to the UBS for recharging and maintaining the charge of the UBS when deemed necessary by the control circuitry 24.

The combination of the UPS/UBS works like an "infinite" battery. This combination keeps the computer 28 as well as the other electrical components powered for extended periods of time, certainly until such time that any problem with the photovoltaic power and charging system can be corrected. With failure of the photovoltaic system, therefore, the system can continue to be operational for hours, days or even weeks. Essentially, the UBS connects with the UPS batteries. When determined to be necessary, the UPS automatically switches to battery power without any interruption to the protected equipment. As the UPS batteries' voltage begins to drop, the UBS micro-processor continuously monitors those batteries. When voltage falls to a pre-set valve for a specified length of time, the UBS starts automatically. UBS units of the type under discussion are distributed by Best Power Technology, Inc. of Necedah, Wis.

The computer 28 is in the nature of a micro-processor-based programmable logic controller (PLC) that is micro-programmable. The specific micro-programmable controller used is not critical for purposes of the present invention. However, by way of example only, a programmable controller sold by Idec Corporation of Sunnyvale, Calif. as "Micro-1" has been found to be suitable for the purposes of the present invention. The aforementioned controller is provided with a keyboard program loader that facilitates the programming of the controller. The unit has up to 16 inputs and 12 outputs and has a program capacity of six hundred steps (words), and eighty timers. Programming can be done using familiar relay symbol format. Applications software (Latter Input Program) is available for programming on an IBM or compatible personal computers in connection with well-known programming techniques.

The microwave signal generator and receiver 30 is controlled by the computer 28 and provides signals to microwave communications antenna 114 mounted on the roof 86 of the shed 22.

Figure 7:
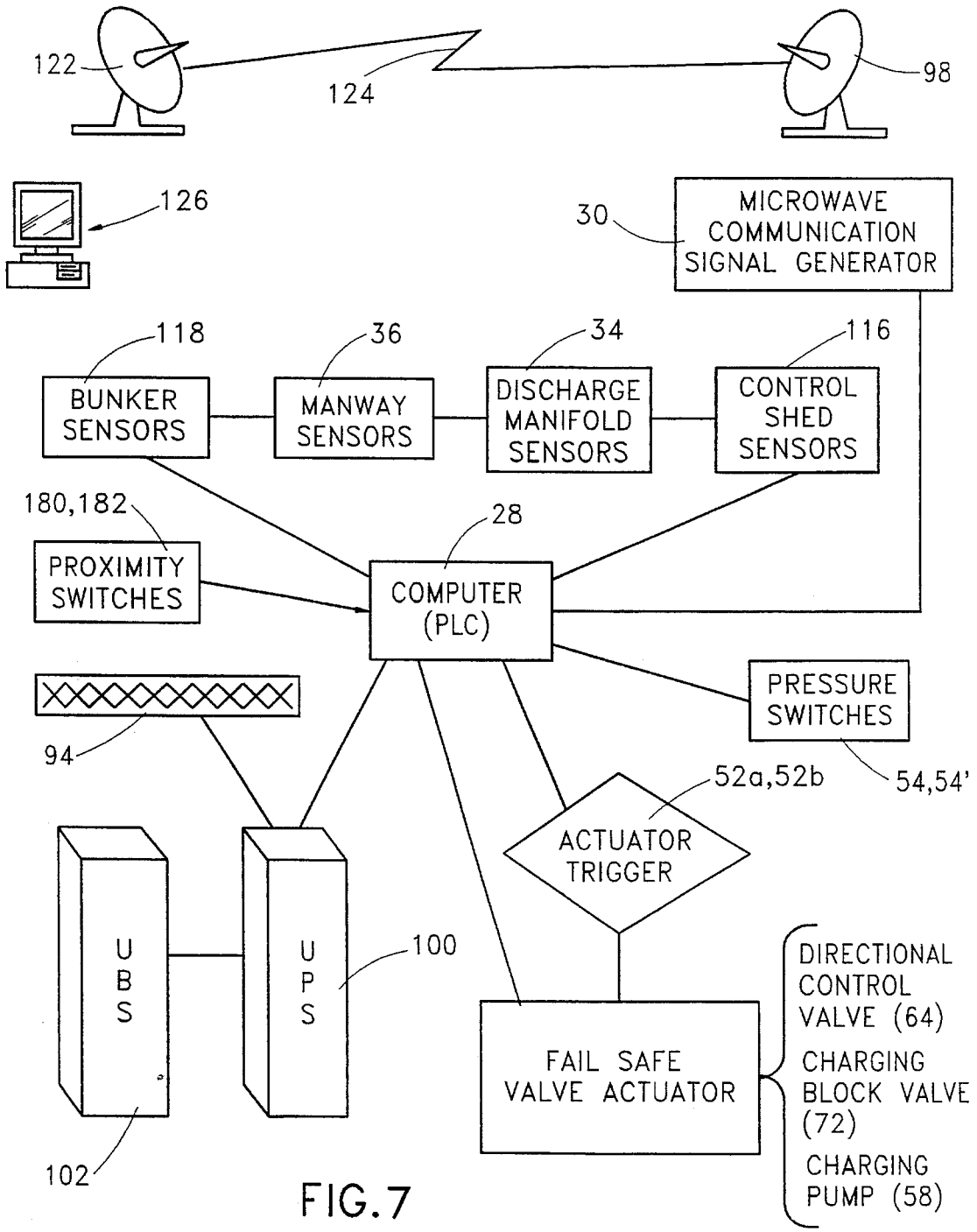
FIG. 7 is a block diagram illustrating the primary control elements used in the shut-off control system, and also the communication link which is advantageously used for remote monitoring and control.

The overview of the system is illustrated in block diagram format in FIG. 7. The computer or PLC 28 provides the logic for the system. By monitoring the sensors 34, 36, 116 and 118 and the proximity switches is 180, 182, the computer 28 can control communications via the microwave communication signal generator 30. By also monitoring the proximity switches 180, 182 and the pressure switches 54, 54', the computer 28 also controls the trigger valves **52*a*, 52*b* as well as the fail-safe valve actuator 120 which entails control over the directional control valve 64, the charging block valve 72 and the charging pump 58**.

The computer or PLC 28, identified above, is equipped with a built-in telephone modem. In the presently preferred embodiment, a remote antenna 122 provides a microwave communication link 124 between the computer 28 and a computer (CPU) at a base control station 126. Direct, on-line communication with the CPU 126 at the base control station 126 takes place continuously. All systems can be monitored, including flow rate from the well, UBS-UPS condition, actuator 44 position, and sensor integrity. The well can be shut down instantly from the CPU by either computer program, lack of communication and/or operator signal. It can only advantageously be restarted from the CPU command station 126.

Figure 8:
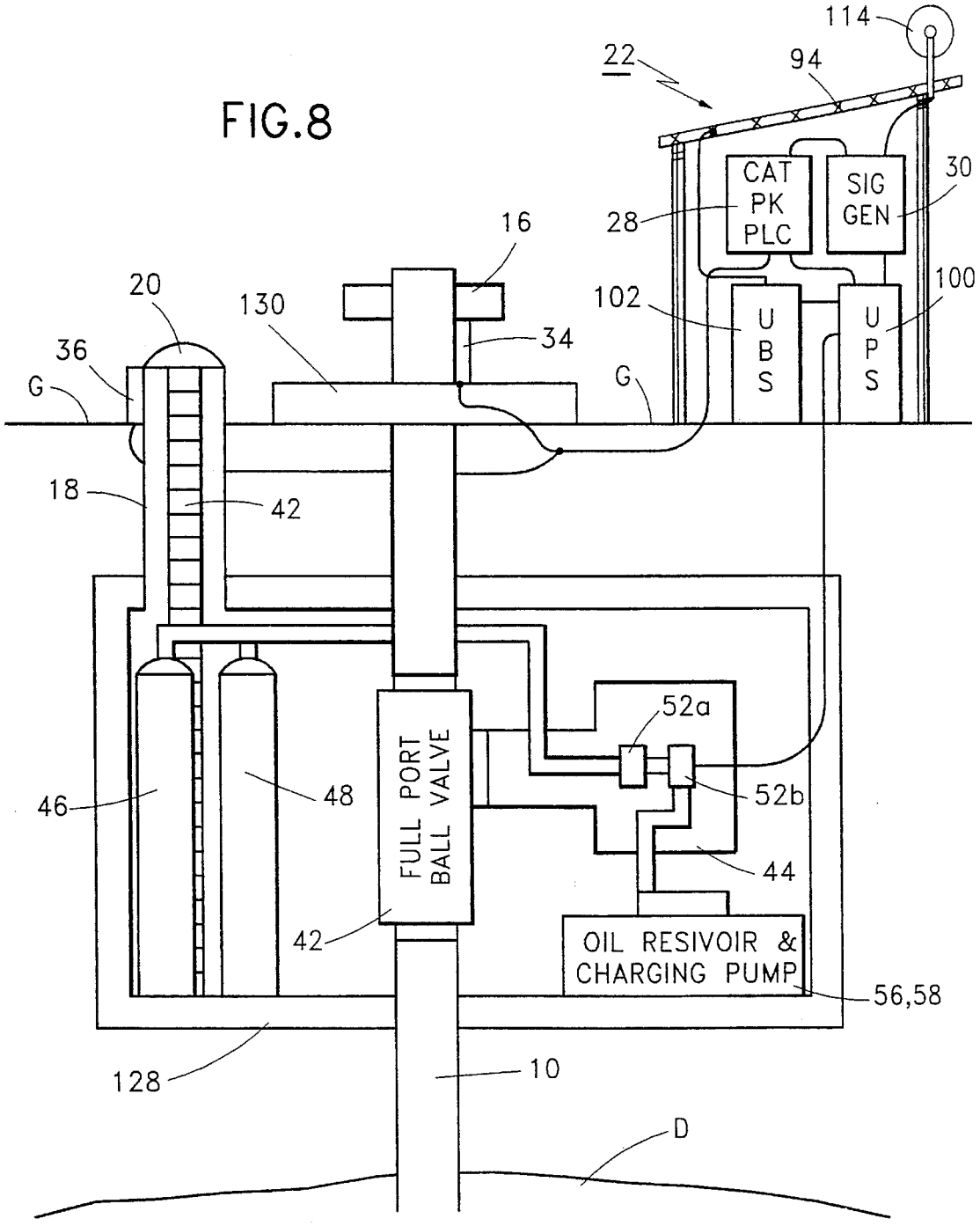
FIG. 8 is similar to FIGS. 1 and 4, but illustrating a modified bunker configuration and some additional modifications.

In FIG. 8, a slightly modified embodiment of the system shown in FIGS. 1–7 is illustrated, wherein the discharge manifold 16 is mounted on a well platform 130, and the poured concrete bunker 128 is in the form of a rectangular housing, with the hydraulic accumulators 46, 48 and the oil reservoir and charging pump 56, 58 being placed directly upon the lower wall of the bunker. In other respects, the embodiment shown in FIGS. 1–8 is the same both structurally and functionally.

The valve actuator 44 support system needs constant voltage, such a 110 volts AC, to power and maintain the trigger solenoids **52*a*, 52*b* in the closed position. Upon even momentary absence of power, the solenoids 52*a*, 52*b* open, discharging stored energy from the hydraulic accumulators 46, 48 to close the main valve 42 (FIG. 4) via the hydraulic actuator 44. This action stops the flow of the product to the wellhead manifold 16** (Christmas tree) in three to five seconds.

All critical components (e.g. main shut-off valve, hydraulic accumulators, trigger solenoids, and valve actuator), are located in the bomb proof steel reinforced bunker 12 at least 10–20 feet below ground or surface G. The wood frame control room or shed 22 is above ground and is designed to be sacrificial. Any destructive action to the shed 22 will: (1) remove power from the trigger valves **52*a*, 52*b*, releasing stored hydraulic energy, which closes the valve 42 in 3–5 seconds; (2) eliminate the microwave communication link 124, thereby the notifying a central station 126** of a natural disaster, terrorist act or other unusual situation.

Any explosion, shock, or vibration above a predetermined threshold level is picked up by sensors on the major critical components. Such an event signals the computer 28 in the control power shed to take the following action: (1) shutdown the bunker main valve 42, stopping fire or spills within 3–5 second; (2) send a signal via microwave link 124 to the central control station 126 that there is an alarm condition.

Sensors can also detect fire via heat monitoring, manifold pressure, shock, vibration and tampering. All inputs are treated the same, i.e. instant closure of the below ground bunker's main valve 44, stopping flow to the surface. In remote areas, where there is no available electrical power, the control shed is primarily powered by photovoltaic cells 94, a UPS system 98 and UBS generator system 100 is powered by L/P or waste gas from the well itself. These components can supply enough uninterrupted power to the trigger valves **52*a*, 62*b*, sensors, microwave and computer power. Any abnormality or disturbance of these components removes constant power to the trigger solenoids 52*a*, 52*b* and the valve 42** closes within 3 to 5 seconds.

Since the purpose of the system is to stop the product (gas or oil) from getting to the surface where it can spill or burn, all components should be designed to be fail-safe. Upon any component failure, the system will shut down. Restarting the system requires at least one to two hours of UBS generated power to run the ⅓ HP recharging pump 58. Only after the hydraulic accumulators 46, 48 are fully recharged will the computer 28 permit the main valve 42 driven open. Any malfunction or disturbance automatically closes the valve and stabilizes the system. There is preferably no manual override, nor any way the main vale 42 can be opened without the integrity of all control components and a signal from the central control station or base 126.

The operation of the control system may be better understood from a description of the various modes or stages of operation, referring particularly to FIGS. 5 and 7. In order to render the system operational, the hydraulic accumulators 46, 48 must be fully charged. Initially, the power must be on. Such power may be provided by the solar collectors or panels 94 or the UPS 98. The UBS generator 100 should be running and operational. The cycle is started (or restatted) by a command given to the computer 28 by the remote CPU at the base control station 126 over the microwave link 124. As soon as power is turned to the system, a voltage is applied to the trigger valves 52*a*, 52*b* to close the valves and, thereby, block fluid flow in the conduit 50 between the accumulators and the actuator cylinder 44. The computer 28 also applies power to the charging block solenoid 72, although no power is initially applied to the directional valve 64, which is spring loaded to the position shown when no power is applied to it. Once the aforementioned valves are in their desired positions, the computer 38 applies a signal to the charging pump 58 to start charging the accumulators. It will be noted that application of power to the charging block solenoid 72 moves the solenoid to the closed or fluid blocking position, thereby opening the conduit 70 and isolating the charging pump and accumulators from the rest of the hydraulic system. This avoids relatively high pressures being applied for extended periods of time to the actuator cylinder 44 and prolongs the life of the cylinder by protecting the seals and other parts associated with the cylinder. The charging pump 58 thereupon pumps the hydraulic oil or fluid from the reservoir 56 into the hydraulic accumulators which are initially charged to approximately 2,000 psi. At 2,000 psi, or at any other predetermined level, the control pressure switches 54, 54' communicate such threshold pressure to the computer 28, at which time the computer 28 actuates the directional valve 64 by applying a voltage to its solenoid. At this time, the high pressure side of the charging pump 58 continues to charge the accumulators 46, 48 but some of the hydraulic oil or liquid under pressure is also diverted through check valve 76 into the lower chamber 44*f*, as viewed in FIG. 5. During this starting, resetting or valve 42 opening phase, the charging block solenoid 72 is de-energized so to allow hydraulic fluid in chamber 44*e* to be diverted and drained into the oil reservoir 56 through conduit 70. As the rod 44*g* is retracted into the actuator cylinder, the main valve 42 is opened. This starting, resetting or valve opening procedure continues until the piston 44*d* moves to the upper axial end of the cylinder, as viewed in FIG. 5, into proximity with the switch 80. As soon as the computer 28 is provided with a signal that the proximity switch 80 has been actuated by the piston 44d, the power is removed from the solenoid of the directional valve 64 and it reverts, due to spring biassing action, to the position shown in FIG. 5. The charging pump 58 stays on line and tops off the accumulators at between 2200–3000 psi, at which point the accumulator pressure switches 54, 54' signal computer 28 to shut down the charging/open cycle and discontinue the operation of the charging pump 58.

Once the accumulators 46, 48 have been fully charged and the actuator 44 has been moved to its full valve open position, the system is in "standby" mode and ready to respond to any abnormal sensed condition or manual closure command. In such "standby" mode, no power is supplied to either the charging block solenoid 72*n* or to the solenoid of the directional valve 64. Power is only applied to the dual trigger valves 52*a*, 52*b*, so as to effectively block fluid flow through the main conduit 50.

To manually close the well, the CPU at the base control station 116 can transmit, via microwave link 124, a command to the computer 68 to close the valve. Upon receipt of such request for manual closure, the computer 28 removes energy or power from the trigger solenoid valves 52*a*, 52*b* and the system thus immediately shuts down due to the flow of hydraulic fluid, under high pressure, from the accumulators 46, 48 into the upper chamber 44*e* of the actuator cylinder 44*a*. This forces the piston downwardly to the valve closed position, thereby closing the main valve 42. The system will not reopen until a specific command is received from the CPU at the base control station 126 to restart the computer 28 programmed "system recharge and valve to open" logic.

Under normal fail-safe and emergency operational conditions, an automatic closure response will be provoked by any one of the following conditions: sensors in the system detect an abnormality; UPS-UBS failure; computer 28 failure; trigger valve 52*a*, 52*b* failure, communications link 124 lost; tampering or intrusion detection by sensors; any wires cut; momentary power outage of any kind. It will be understood that this list of possible abnormal conditions is not intended to be all inclusive but merely exemplary of the types of emergency conditions which can be provided for. Upon detection of any of the aforementioned conditions, or any others which can be specifically provided for by sensors or the like, power on the trigger solenoids 52*a*, 52*b* is immediately removed, the trigger valves 52*a*, 52*b* move to the open or fluid flow positions, releasing the stored energy in the accumulators by flow of hydraulic fluid under pressure through the main conduit 50 and through the optional speed control unit 78 into the upper chamber 44*e*, thereby extending the rod 44*g* to the valve closing position. The pressurized hydraulic fluid drives the valve actuator closed in approximately 3 to 5 seconds.

The piston 44*d* continues to move downwardly as viewed in FIG. 5, for approximately 3 to 5 seconds until the piston comes into proximity with the switch 82. When this happens, the proximity switch 82 signals the computer 38 that the main valve 42 is closed, and the computer 28 signals the CPU at the base control station 126 that the system is shut down and stabilized.

The computer 28, if it is still powered, (if no damage has been done to the shed 22 and the equipment therein), signals the CPU at the base or control station 126 of the reason for the shut down and signals an appropriate alarm. Once the actuator cylinder 44 is fully extended, the system is stabilized and the wellhead shut off by closure of the valve 42 with no spill or fire. As indicated, the computer 28 is programmed so that the restart cycle can only commence once an appropriate signal has been received from the CPU at the remote or base station 126, in which case an automatic reopening will occur as described above if all the systems are functioning correctly and reporting to the computer 28. For this reason, it will be clear, the system described in FIGS. 1–8 is a fail-safe system which operates automatically and almost instantaneously upon the occurrence of any abnormal condition which requires immediate shut down to prevent oil spillage or fires.

Figure 9:
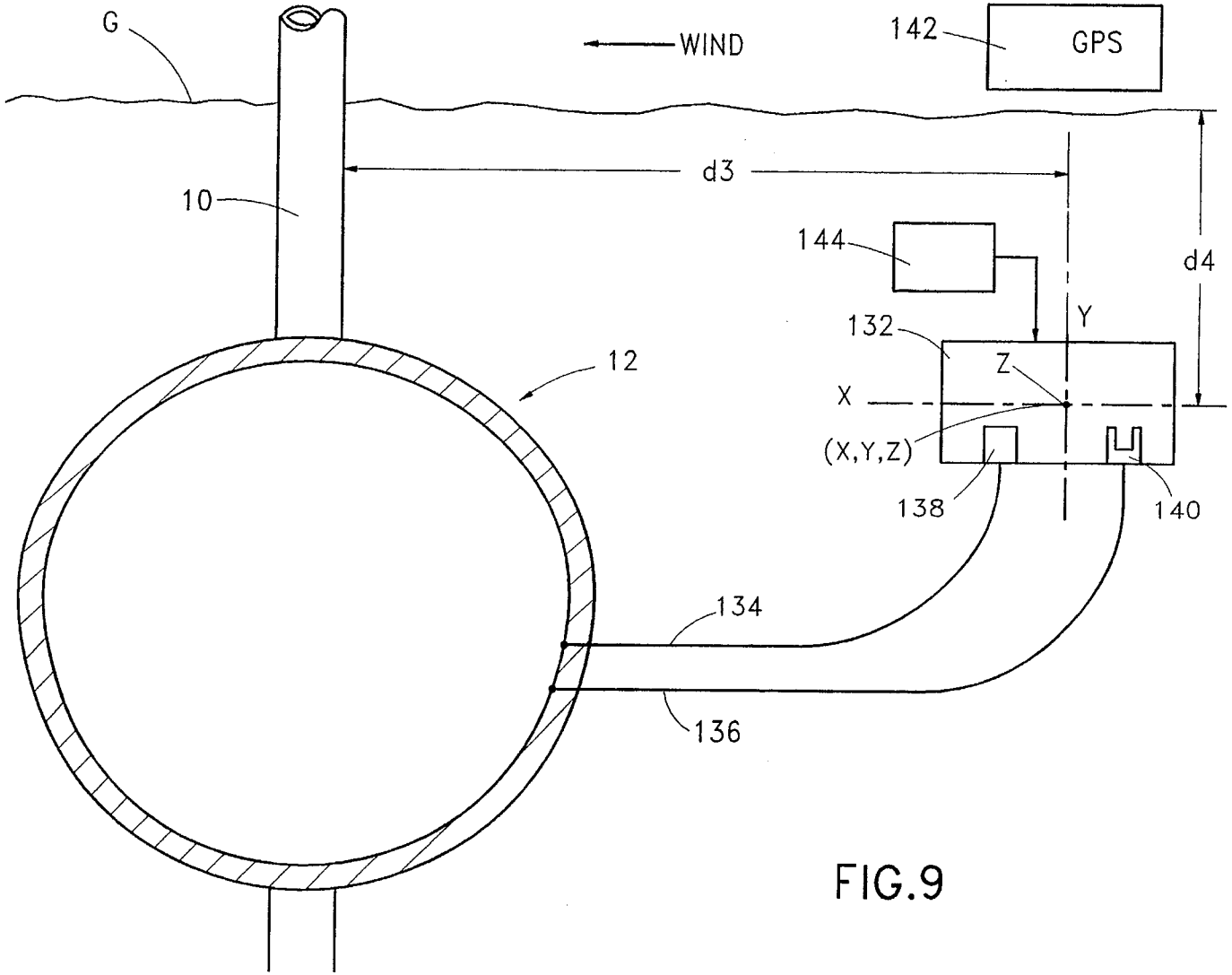
FIG. 9 is a schematic representation of an alternate embodiment of a shut-off control system in accordance with the present invention for manually closing the main casing valve, as opposed to the first embodiment in which closure is automatic.
Figure 10:
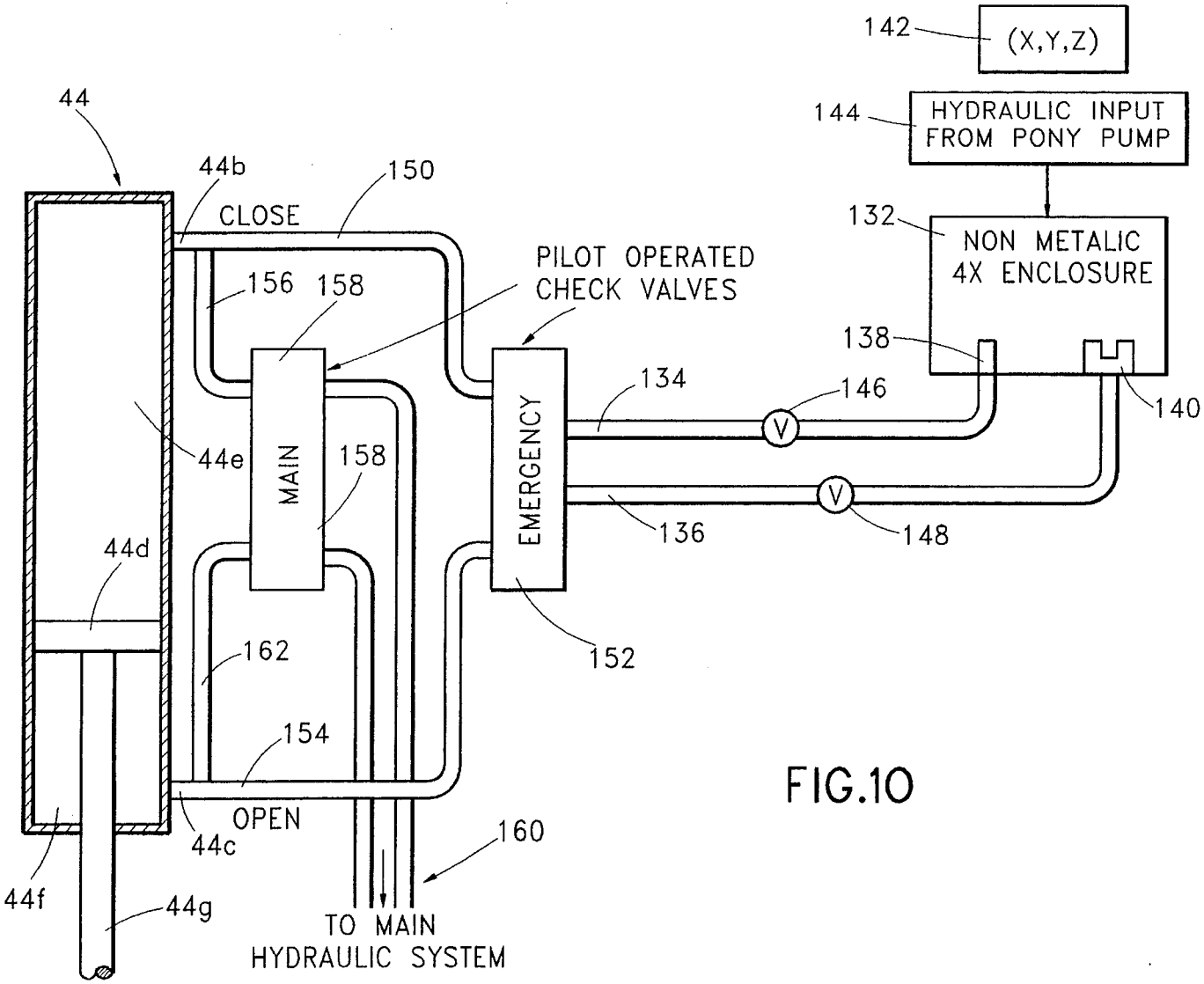
FIG. 10 is a schematic representation of the hydraulic system employed in conjunction with the embodiment shown in FIG. 9.

Referring to FIGS. 9 and 10, another embodiment is illustrated which can be used as a stand alone substitute alternate embodiment to the one described or illustrated in FIGS. 1–8 or can be used in conjunction with such aforementioned embodiment as a secondary emergency closure method and apparatus. In the description that follows, the device as shown in FIGS. 9 and 10 will be described as a secondary emergency closure method for use in conjunction with the fail-safe system previously described. However, it will be evident to those skilled in the art, that such system can be used separately and apart from such fail-safe system.

When used in combination with the fail-safe system, in the almost impossible event that all redundant systems fail and the valve 42 does not close, the device and method illustrated in FIGS. 9 and 10 can be used as a last resort for shutting down the valve 42. This emergency system uses a separate hydraulic circuit isolated from the primary circuit illustrated in FIG. 5. The secondary emergency closure method operates with the actuator 44 which includes hydraulic lines 44*b* and 44*c*. An important feature of this secondary closure system is the provision of an enclosure 132 which is arranged below ground level G at a location the spatial coordinates (x, y, z) which can be determined by use of a hand-held global positioning system (GPS) satellite tracker unit 142 or in any other conventional way. The enclosure or box well 132 is buried below the ground level G a distance $d_4$ in the range of approximately 8–10 feet in a distance $d_3$ of approximate 25–75 feet from the casing 10. The casing is preferably non-metallic so that the enclosure cannot be detected by use of metal detectors or the like. Two non-metallic braided high pressure hoses 134, 136 are connected from the bunker 12 to the enclosure 132, preferably up-wind of the bunker 12. The braided hydraulic lines 134, 136 terminate at the enclosure 132 which can be a nonmetallic NEMA 4X enclosure using two separate and distinct connectors 138,140 respectively within the enclosure. In this manner, the location of the enclosure 132 is difficult to find using means other than a controlled locator, which is proprietary. Any suitable satellite tracking device, such as a Garmin hand-held Global Positioning System (GPS) satellite tracking unit 142 is able to pinpoint the exact coordinates of the location of the enclosure 132, within two square feet. In the event of total failure, the GPS can locate the enclosure on the surface the area to dig in order to recover the box or enclosure 132. Once excavated, a small gasoline driven hydraulic pony pump 144 is attached to the quick disconnect hoses and the actuator 44 can be driven to the valve closed condition. The fail-safe hydraulic circuit would not allow any actuator/valve movement except to the closed position.

As will be evident, the secondary emergency closure device and method shown in FIGS. 9 and 10 can be used without the fail-safe system described in connection with FIGS. 1–8 or can be used with it as a secondary and redundant closure system.

Having described the invention, many modifications thereto will become apparent to those skilled in the art to which it pertains without deviation from the spirit of the invention as defined by the scope of the appended claims. Thus, for example, the bunker 12 has been shown for both embodiments as being a relatively large walk-in structure. This is preferred where the bunker contains hydraulic accumulators, hydraulic lines, etc. that need periodic maintenance. However, the present invention also contemplates less costly systems, more along the lines of the second embodiment (FIGS. 9 and 10) which do not use accumulators, etc. To minimize installation costs, the valve 42 and/or actuator may be housed in any protective enclosure that can be buried below ground. Such enclosure can be relatively much smaller and would not normally need a manway extending above ground level, so that there would not, with such an approach, be any visible evidence of a shut-down system at the well site. The valve/actuator could be actuated by use of hydraulics (as in FIGS. 9 and 10), mechanics (e.g. using reach rods utilizing universal joints) or electrical power (such as by using external and/or portable power supply to power electrical solenoid, motor drive, etc.). The enclosure, with such a reduced cost system, need only be large enough to house the main valve 42 and/or the accumulator 44.

I claim:

1. Shut-off control system for an oil/gas well casing an upper portion of which extends above ground level and is connected to a discharge manifold and a lower portion of which extends below ground level to an oil/gas dome from which oil or gas is extracted, said control system comprising a protective enclosure positioned a predetermined distance below ground level and being substantially fully enclosed but having input and output openings through which said well casing enters and exits said enclosure; and having entry means for providing entry to said enclosure to authorized personnel means within said enclosure for permitting flow of oil or gas through said well casing when in an open condition and for inhibiting flow through said casing when in a closed condition; actuator means mechanically coupled to said valve means for actuating said valve means for actuating said valve means to said open or closed conditions; and normally inaccessible closure means at least partially disposed below ground level and connected to said actuator means for selectively controlling the condition of said actuator means, whereby undesired flow of oil/gas can be terminated in the event of an abnormal alarm condition at the discharge manifold with said entry means being coupled to said actuator means for closing said valve means upon unauthorized opening of said entry means.

2. Control system as defined by claim 1, wherein protective enclosure comprises an explosion-proof bunker and said closure means comprises accumulator means for accumulating stored energy; sensor means for sensing at least one alarm condition; and control circuit means for monitoring said sensor means and for issuing an alarm signal when an alarm condition is detected and for applying said energy stored in said accumulator means to said actuator means upon the occurrence of an alarm condition, whereby said valve means can close the flow of oil/gas in the well casing upon the occurrence of an alarm condition.

3. Control system as defined by claim 1, wherein said protective enclosure is positioned within the range of 10–20 feet below ground level.

4. Control system as defined by claim 2, wherein said accumulator means comprises a hydraulic accumulator and said actuator means comprises a hydraulic actuator.

5. Control system as defined by claim 1, wherein said protective enclosure comprises an explosion-proof bunker formed as a cast-in-place shell of steel-reinforced concrete.

6. Control system as defined by claim 5, wherein said explosion-proof bunker is rectangular in shape.

7. Control system as defined by claim 5, wherein said explosion-proof bunker is spherical in shape.

8. Control system as defined by claim 2, wherein said sensor means comprises at least one sensor for sensing an explosion proximate to said explosion-proof bunker.

9. Control system as defined by claim 2, wherein said sensor means comprises at least one sensor for sensing abnormal temperatures proximate to said explosion-proof bunker.

10. Control system as defined by claim 2, wherein said sensor means comprises at least one sensor for sensing head pressure or flow rate through the discharge manifold.

11. Control system as defined by claim 2, wherein said control circuit means comprises at least one electrical solenoid valve in-line between said accumulator means and said actuator means for applying said stored energy of said accumulator means to said actuator means when an alarm signal is applied to said at least one solenoid valve and preventing application of said stored energy in the absence of an alarm signal.

12. Control system as defined by claim 11, wherein said control circuit means includes microcomputer means for monitoring said at least one sensor means and issuing said alarm signal upon detection of an alarm condition.

13. Control system as defined by claim 12, wherein a plurality of sensor means are provided for sensing a plurality of abnormal conditions, said microcomputer being programmed to monitor all said sensor means and issue an alarm signal when an alarm condition is sensed by any one of said plurality of sensor means.

14. Control system as defined by claim 2, wherein said control circuit means includes power means for energizing said control circuit means.

15. Control system as defined by claim 14, wherein said power means includes an uninterruptable power supply (UPS); and charging means for charging said UPS.

16. Control system as defined by claim 15, wherein said charging means comprises a source of AC power.

17. Control system as defined by claim 15, wherein said charging means includes means for converting a source of liquid propane (L/P) into electricity.

18. Control system as defined by claim 15, wherein said charging means includes means for converting natural waste gas into electricity.

19. Control system as defined by claim 15, wherein said power means includes an uninterruptable battery supply (UBS) for charging said UPS when a voltage of said UPS drops below a predetermined value.

20. Control system as defined by claim 15, wherein said charging means includes means for converting solar energy into electricity.

21. Control system as defined by claim 20, further comprising an above ground level structure in relative proximity to the discharge manifold for housing at least a portion of said control circuit means and said power means, said structure having a roof, and said charging means including photovoltaic collectors arranged on said roof.

22. Control system as defined by claim 2, further comprising communication means responsive to said control circuit means for transmitting an alarm message to a remote station upon the issuance of an alarm signal.

23. Control system as defined by claim 22, wherein said communication means includes a microwave link.

24. Control system as defined by claim 2, wherein said accumulator means stores fluid under pressure and is in fluid flow communication with said actuator means through at least one solenoid-controlled trigger valve for selectively applying said fluid under pressure to said actuator means, said at least one trigger valve being connected to said control circuit means whereby said trigger valves may be selectively opened by said control circuit means for applying said fluid under pressure to said actuator means.

25. Control system as defined by claim 24, wherein two trigger valves are provided and are connected in tandem or in series between said accumulator means and said actuator means.

26. Control system as defined by claim 24, wherein said at least one trigger valve is normally open, whereby loss of energy to the solenoid of said trigger valve automatically applies said fluid under pressure.

27. Control system as defined in claim 1, wherein said actuator means is hydraulically driven and said closure means includes at least one hydraulic connector and hydraulic line below ground level at a location the spatial coordinates of which are pre-established for externally applying hydraulic pressures to said actuator means.

28. Control system as defined in claim 1, wherein said actuator means is electrically driven and said closure means includes at least one electrical connector and electrical line below ground level at a location the spatial coordinates of which are pre-established for externally applying electrical power to said actuator means.

29. Control system as defined in claim 1, wherein said actuator means is mechanically driven and said closure means includes at least one mechanical member below ground level at a location the spatial coordinates of which are pre-established for externally applying mechanical power to said actuator means by means of said mechanical member.

30. Control system as defined in claim 29, wherein said at least one mechanical member comprises at least one reach rod.

31. Control system as defined in claim 29, further comprising a universal joint for mechanically coupling said mechanical member to said actuator means.

32. Shut-off control system for an oil/gas well casing an upper portion of which extends above ground level and is connected to a discharge manifold and a lower portion of which extends below ground level to an oil/gas dome from which oil or gas is extracted, said control system comprising a protective enclosure positioned a predetermined distance below ground level and being substantially fully enclosed but having input and output openings through which said well casing enters and exits said enclosure; valve means within said enclosure for permitting flow of oil or gas through said well casing when in an open condition and for inhibiting flow through said casing when in a closed condition; actuator means mechanically coupled to said valve means for actuating said valve means to said open or closed conditions; and normally inaccessible closure means at least partially disposed below ground level and connected to said actuator means for selectively controlling the condition of said actuator means, whereby undesired flow of oil/gas can be terminated in the event of an abnormal condition at the discharge manifold, said protective enclosure comprising an explosion-proof enclosure and said closure means comprises accumulator means for accumulating stored energy; sensor means for sensing at least one alarm condition; and control circuit means for monitoring said sensor means and for issuing an alarm signal when an alarm condition is detected and for applying said energy stored in said accumulator means to said actuator means upon the occurrence of an alarm condition, whereby said valve means can close the flow of oil/gas in the well casing upon the occurrence of an alarm condition, and said sensor means comprising at least one sensor for sensing unauthorized entry into said explosion-proof enclosure.

33. Shut-off control system for an oil/gas well casing an upper portion of which extends above ground level and is connected to a discharge manifold and a lower portion of which extends below ground level to an oil/gas dome from which oil or gas is extracted, said control system comprising a protective enclosure positioned a predetermined distance below ground level and being substantially fully enclosed but having input and output openings through which said well casing enters and exits said enclosure; valve means within said enclosure for permitting flow of oil or gas through said well casing when in an open condition and for inhibiting flow through said casing when in a closed condition; actuator means mechanically coupled to said valve means for actuating said valve means to said open or closed conditions; and normally inaccessible closure means at least partially disposed below ground level and connected to said actuator means for selectively controlling the condition of said actuator means, whereby undesired flow of oil/gas can be terminated in the event of an abnormal condition at the discharge manifold, said protective enclosure comprising an explosion-proof bunker and said closure means comprises accumulator means for accumulating stored energy; sensor means for sensing at least one alarm condition; and control circuit means for monitoring said sensor means and for issuing an alarm signal when an alarm condition is detected and for applying said energy stored in said accumulator means to said actuator means upon the occurrence of an alarm condition, whereby said valve means can close the flow of oil/gas in the well casing upon the occurrence of an alarm condition, said sensor means comprising at least one sensor for sensing tampering with the region of said explosion-proof bunker.

34. Shut-off control system for an oil/gas well casing an upper portion of which extends above ground level and is connected to a discharge manifold and a lower portion of which extends below ground level to an oil/gas dome from which oil or gas is extracted, said control system comprising a protective enclosure positioned a predetermined distance below ground level and being substantially fully enclosed but having input and output openings through which said well casing enters and exits said enclosure; valve means within said enclosure for permitting flow of oil or gas through said well casing when in an open condition and for inhibiting flow through said casing when in a closed condition; actuator means mechanically coupled to said valve means for actuating said valve to said open or closed conditions; and normally inaccessible closure means at least partially disposed below ground level and connected to said actuator means selectively controlling the condition of said actuator means, whereby undesired flow of oil/gas can be terminated in the event of an abnormal condition at the discharge manifold, said protective enclosure comprising an explosion-proof bunker and said closure means comprises accumulator means for accumulating stored energy; sensor means for sensing at least one alarm condition; and control circuit means for monitoring said sensor means and for issuing an alarm signal when an alarm condition is detected and for applying said energy stored in said accumulator means to said actuator means upon the occurrence of an alarm condition, whereby said valve means can close the flow of oil/gas in the well casing upon the occurrence of an alarm condition, further comprising a sacrificial above-ground structure in relative proximity to the discharge manifold for housing at least a portion of said control circuit means, said sensor means including a sensor for monitoring the integrity of said structure and designed to shatter and disintegrate upon the occurrence of an explosion in proximity to the discharge manifold to thereby issue an alarm signal.

35. Shut-off control system for an oil/gas well casing an upper portion of which extends above ground level and is connected to a discharge manifold and a lower portion of which extends below ground level to an oil/gas dome from which oil or gas is extracted, said control system comprising a protective enclosure positioned a predetermined distance below ground level and being substantially fully enclosed but having input and output openings through which said well casing enters and exits said enclosure; valve means within said enclosure for permitting flow of oil or gas through said well casing when in an open condition and for inhibiting flow through said casing when in a closed condition; actuator means mechanically coupled to said valve means for actuating said valve means to said open or closed conditions; and normally inaccessible closure means at least partially disposed below ground level and connected to said actuator means for selectively controlling the condition of said actuator means, whereby undesired flow of oil/gas can be terminated in the event of an abnormal condition at the discharge manifold said actuator means comprising a hydraulic actuator which includes a cylinder with first and second hydraulic lines, and a piston within said cylinder connected to a retractable and extendable rod coupled to said valve means, whereby application of hydraulic fluid under pressure to said second hydraulic line opens said valve means; and further comprising a second enclosure arranged below ground level at a location the spatial coordinates of which are pre-established; two separate and distinct connectors within said second enclosure; hydraulic conduits connecting each of said connectors to another one of said first and second hydraulic lines; and check valve means for preventing the escape of hydraulic fluid from said hydraulic conduits through said connectors, whereby location of enclosure and selective application of a pump with a mating connector to one of said two distinct connectors within said enclosure; hydraulic conduits connecting each of said to connectors to another one of said first and second hydraulic lines; and check valve means for preventing the escape of hydraulic fluid from said hydraulic conduits through said connectors, whereby location of enclosure and selective application of a pump with a mating connector to one of said two distinct connectors enables said valve means to be opened or closed.

36. Control system as defined in claim 35, wherein said two connectors are male and female connectors to insure proper identification and application of hydraulic fluid under pressure to the appropriate conduit.

37. Control system as defined in claim 35, further comprising a pony pump for application of hydraulic fluid under pressure to one of said connectors.

38. Control system as defined in claim 35, further comprising a global positioning system (GPS) satellite tracker to pinpoint the coordinates of said enclosure when same is arranged below ground level in order to gain access to said connectors.

* * * * *